US006968970B1

(12) United States Patent
Shacklee

(10) Patent No.: US 6,968,970 B1
(45) Date of Patent: Nov. 29, 2005

(54) AMMUNITION SHIPPING AND STORAGE CONTAINER AND METHOD

(75) Inventor: Franky Lee Shacklee, Whitesboro, TX (US)

(73) Assignee: Raytheon Company, Waltham, MA (US)

( * ) Notice: Subject to any disclaimer, the term of this patent is extended or adjusted under 35 U.S.C. 154(b) by 550 days.

(21) Appl. No.: 09/900,808

(22) Filed: Jul. 6, 2001

Related U.S. Application Data

(63) Continuation of application No. 09/224,218, filed on Dec. 30, 1998, now Pat. No. 6,290,087.

(51) Int. Cl.[7] ..... B65D 88/06
(52) U.S. Cl. ..... 220/565
(58) Field of Search ..... 206/3, 821, 511, 206/509, 504, 503, 386; 220/1.5, 565, 567, 220/592, 581, 582, 324, 649, 648, 646, 737, 220/752, 756, 758

(56) References Cited

U.S. PATENT DOCUMENTS

| | | | | |
|---|---|---|---|---|
| 2,916,141 A | | 12/1959 | Arnot | 206/46 |
| 3,229,825 A | | 1/1966 | Brown | 206/504 |
| 3,446,394 A | | 5/1969 | Miller et al. | 206/511 |
| 3,599,826 A | * | 8/1971 | Rocher | 220/324 |
| 3,628,793 A | | 12/1971 | Mudloff | 273/105 |
| 3,939,967 A | | 2/1976 | Tenney et al. | 206/3 |
| 4,494,666 A | | 1/1985 | Cooper et al. | 220/582 |
| 4,566,588 A | | 1/1986 | Kataczynski | 206/3 |
| 4,660,733 A | | 4/1987 | Snyder et al. | 220/69 |
| 4,733,773 A | | 3/1988 | LaBianca et al. | 206/3 |
| 4,785,930 A | | 11/1988 | Fischer et al. | 206/3 |
| 4,847,028 A | | 7/1989 | Snyder et al. | 264/155 |
| 4,979,632 A | | 12/1990 | Lee | 220/3 |
| 4,989,741 A | | 2/1991 | Dull et al. | 220/1.5 |
| 5,054,687 A | | 10/1991 | Burns et al. | 239/373 |
| 5,197,601 A | | 3/1993 | Sterett | 206/511 |
| 5,429,268 A | | 7/1995 | Hale et al. | 220/582 |
| 5,438,935 A | * | 8/1995 | Seitz | 105/377.11 |
| 5,531,326 A | | 7/1996 | Hummel et al. | 206/509 |
| 5,628,401 A | | 5/1997 | Broeders | 206/509 |
| 5,813,536 A | | 9/1998 | Bartholomew | 206/449 |
| 6,003,705 A | | 12/1999 | Burguieres, Jr. | 220/1.5 |
| 6,012,598 A | | 1/2000 | Anoniou | 220/1.5 |
| 6,079,580 A | | 6/2000 | Garton et al. | 220/1.5 |
| 6,290,087 B1 | | 9/2001 | Shacklee | 220/582 |
| 6,305,544 B1 | | 10/2001 | Shacklee | 206/509 |

FOREIGN PATENT DOCUMENTS

| | | | |
|---|---|---|---|
| FR | 1090515 | 10/1954 | 206/821 |
| NL | 6514252 | 9/1966 | 206/504 |

OTHER PUBLICATIONS

PCT International Search Report mailed Aug. 22, 2000 for international application PCT/US99/29791 filed Dec. 14, 1999.

* cited by examiner

*Primary Examiner*—Stephen Castellano
(74) *Attorney, Agent, or Firm*—Baker Botts L.L.P.

(57) ABSTRACT

A container system and method for shipping and storing an item is provided. The container system may comprise a storage vessel with an interior compartment, and an access opening at one end. A removable end cap may be releasably and mechanically coupled to the storage vessel at the access opening, fully enclosing the access opening. Mechanical fasteners may also be secured to the storage vessel and removable end cap to form the releasable, mechanical connection. In one embodiment, at least one stacking lug may be provided at the perimeter of the storage vessel. In another embodiment, the container may comprise a pressure vessel, which may be adapted to receive a round of ammunition.

20 Claims, 4 Drawing Sheets

AMMUNITION SHIPPING AND STORAGE CONTAINER AND METHOD

RELATED APPLICATION

This application is a continuation of U.S. application Ser. No. 09/224,218 filed Dec. 30, 1998 entitled Ammunition Shipping and Storage Container and Method, now U.S. Pat. No. 6,290,087.

TECHNICAL FIELD OF THE INVENTION

The present invention relates to shipping and storage containers and systems, and in particular, to a system and method for storing and transporting ammunition.

BACKGROUND OF THE INVENTION

A round of ammunition may include a missile and an associated missile launch tube assembly. In order to protect the round as far forward in a military theater as possible, it is preferable to keep the round in the container as long as possible. Protection is also required for shipping and storage of the round.

Current shipping containers used for missiles and ammunition are typically constructed from aluminum or steel. Aluminum containers are prone to impact damage and puncture, are difficult to seal, require costly maintenance when damaged, and require painting for marking and corrosion resistance in a chemical agent environment or where camouflage is required. Steel containers are a very heavy alternative and do not solve these problems. Also, steel and aluminum containers are expensive since each requires large lengths of welding and gasket-compatible tolerances.

During shipment and storage of the containers, multiple containers are stacked upon one another. It is desirable to secure these containers firmly in place, against one another. Frequently, the weight of the containers causes damage to containers below, requiring repair and/or disposal of damaged containers.

Due to elevation changes inherent in transporting rounds of ammunition, the container may incorporate an automatic pressure relief or "breather" valve to prevent pressure differential between the container and ambient atmosphere. At higher elevations, the breather valve vents air pressure from within the container to account for the associated ambient pressure drop. During descent, air is forced through the breather valve into the container to accommodate increased ambient pressure. As air enters the interior of the container, its contents may be exposed to moisture and other pollutants associated therewith.

SUMMARY OF THE INVENTION

An object of the present invention is to provide a shipping and storage container which can withstand the pressure differential associated with changes in elevation without the use of a breather valve, and, in particular, to provide a container which employs a pressure vessel as the storage media.

Another object is to provide a light-weight shipping and storage container to decrease the burden of vehicular and manual transportation thereof.

Yet another object of the present invention is to reduce the labor and material costs associated with the manufacture of shipping and storage containers.

Still another object is to provide a durable stackable container which can be mobilized and deployed with enhanced efficiency.

The foregoing objects are attained in accordance with the present invention by employing a high strength, "pipe-grade" storage vessel capable of withstanding significant pressure differentials with minimal deformation, as the storage component. In a particular, embodiment, a removable end cap provides access to the interior of the storage vessel. A pair of backing rings may be provided to axially support plastic flanges which form the interface between the end cap and the storage vessel.

In another embodiment, a rubber gasket may be provided to form a generally air-tight seal between the end cap and the storage vessel. In one particular embodiment, one or more stacking lugs may be disposed upon the exterior of the pressure vessel to provide a secure, releasable stacking connection to adjacent storage containers. A number of ergonomic handling features may also be incorporated into the stacking lugs.

In another embodiment, a lever clamp assembly may provide a releasable, mechanical connection between the removable end cap and the storage vessel. The assembly may incorporate a lever clamp "U-bolt" and pivot clamp facilitating the secured coupling and rapid removal of the end cap assembly.

In yet another embodiment, a humidity indicator may be incorporated into the pressure vessel to allow for early detection of a breach in the integrity of the air-tight seal. A manual pressure relief valve may also be provided to breach the air tight seal prior to missile deployment. This allows the operator to remove the end cap without having to overcome the force associated with a pressure differential between the interior of the pressure vessel and ambient environment.

A technical advantage of the present invention includes the ability to withstand pressure differentials without allowing moisture and pollutants to enter the pressure vessel. By limiting the deformation of the container, maintenance and repair due to associated damage is also significantly reduced.

Another technical advantage includes the durable, light weight stackable container which facilitates rapid deployment and ease of transportation. Still other technical advantages of the present invention include providing a weld-sealed, impact-resistant, paint-free, minimum-maintenance alternative using plastic materials and manufacturing techniques.

Other technical advantages will be readily apparent to one skilled in the art from the following figures, detailed description and claims.

BRIEF DESCRIPTION OF THE DRAWINGS

For a more complete understanding of the present invention, and for further features and advantages, reference is now made to the following description, taken in conjunction with the accompanying drawings, in which.

DETAILED DESCRIPTION OF THE INVENTION

Figure 1:
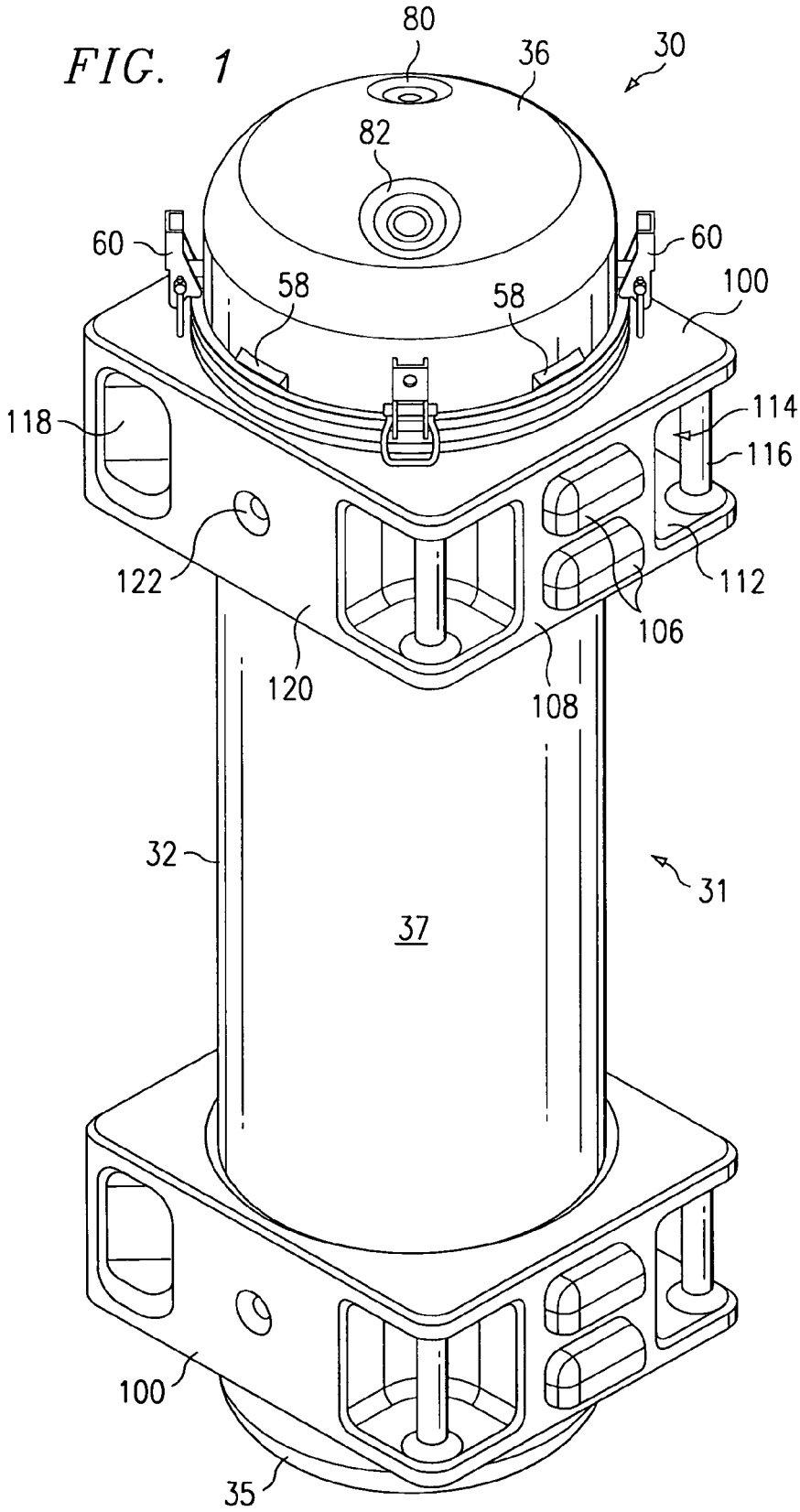
FIG. 1 is a perspective view of a container system embodying aspects of the present invention.

Referring to FIG. 1, a container system comprising a stackable shipping and storage container 30 for rounds of ammunition is provided. Although the illustrated embodiment is suitable to accommodate the United States Army's Javelin® missile, the teachings of the present invention are adaptable to a variety of other shape factors and applications. Examples include shipping containers for other ammunition rounds as well as overpack secondary containment for leaking chemical or biological weapons. The applications listed herein are not intended to be exhaustive, as the disclosed container may be used to ship, store, transport or protect virtually any article of manufacture.

As illustrated in FIG. 1, container 30 includes a generally cylindrical, elongate storage vessel 31 with a removable end cap 36 disposed thereupon. A pair of stacking lugs 100 discussed below in greater detail, provide a high-strength stacking surface for ease in shipping, storage and handling of container 30.

Figure 2:
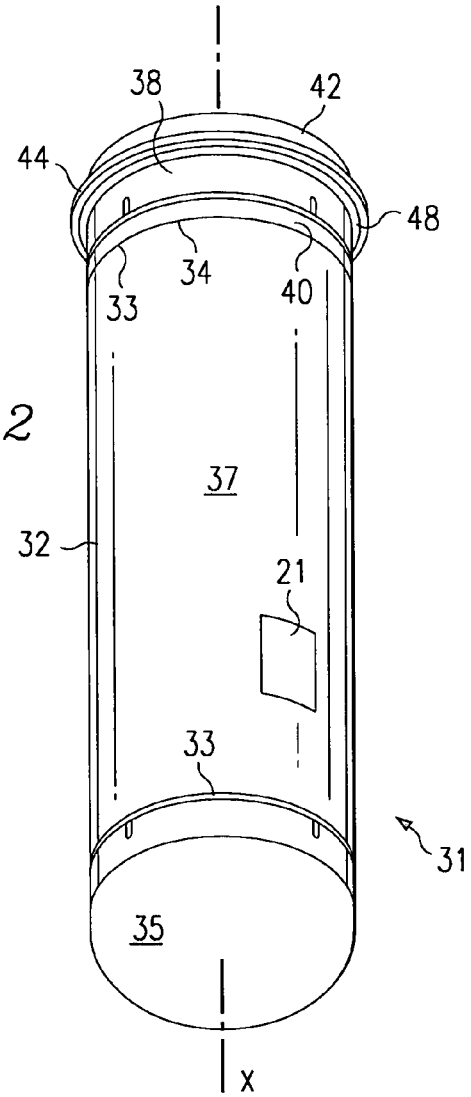
FIG. 2 is a partial perspective view, with portions broken away, of a storage vessel.
Figure 3:
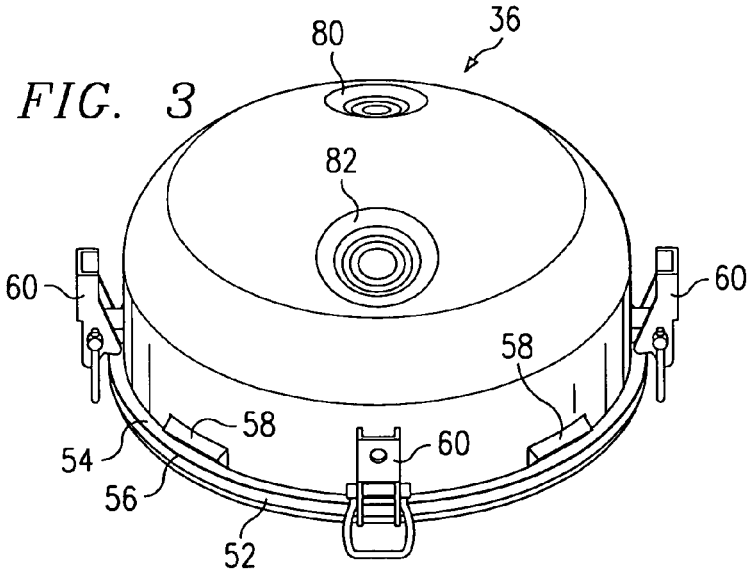
FIG. 3 is a partial perspective view, with portions broken away, of a removable end cap.

Referring now to FIGS. 1–3, storage vessel 31 includes a cylindrical hollow tube 32, fixed end cap 35 and flange assembly 38. Tube 32 partially encloses an interior compartment 37. Tube 32 is open at both ends 33 and 34 is thermally welded to fixed end cap 35 at open end 33. The weld provides a high strength air tight seal between end cap 35 and tube 32. Flange assembly 38 is thermally welded to tube 32, in a similar fashion, at open end 34. In one embodiment, access opening or open end 34 provides access to interior compartment 37.

Storage vessel 31 may be provided with a viewing window 21 to allow viewing of the contents of the storage vessel. For example, if a round of ammunition is contained within vessel 31, a user may wish to view guages associated with the round. Viewing window 21 is preferably formed from a transparent material of sufficient strength to withstand anticipated pressure differentials between the interior and exterior of storage vessel 31. Plexiglass ™, for example, may be used. However, the invention is not so limited and other alternatives may be used. The viewing window may be located anywhere on storage vessel 31. For example, viewing under 21 may be strategically located adjacent a particular part of an item enclosed within storage vessel 31.

Flange assembly 38 includes a first cylindrical neck 40 with a diameter approximately equal to the diameter of hollow tube 32. A second, larger diameter cylindrical neck 42 is provided to interface with removable end cap 36. The diameter of second cylindrical neck 42 is less than the diameter of removable end cap 36. A first circular flange 44 provides a surface upon which a second circular flange 52, associated with removable end cap 36, can join to form an air tight seal therebetween. A gasket (not expressly shown) or other sealing material may be provided at the interface between circular flange 44 and circular flange 52 to enhance the generally air tight seal.

In the illustrated embodiment, removable end cap 36 and storage vessel 31 are primarily composed of extruded, high-density polyethylene 3408, in accordance with ASTM D3350, with a cell classification PE345444C. This material is a "pipe-grade" quality that meets or exceeds the stringent requirements for pressurized applications within an acceptable range of deformation. Accordingly, this facilitates the removal of the previously required automatic breather valve common to prior containers. Furthermore, this material is suitable to withstand significant pressure differentials between interior compartment 37 and ambient environment without significant temporary or permanent deformation. The strength of the material makes it impact and puncture resistant. "Pipe-grade" polyethylene is lightweight, inexpensive, easy to seal with other components of similar or dissimilar material, and does not require painting for marking or corrosion resistance. It will be recognized by those skilled in the art that other high strength materials can be utilized for the fabrication of these components, within the teachings of the present invention. These include but are not limited to, various plastics, metals, and composite materials.

Figure 4:
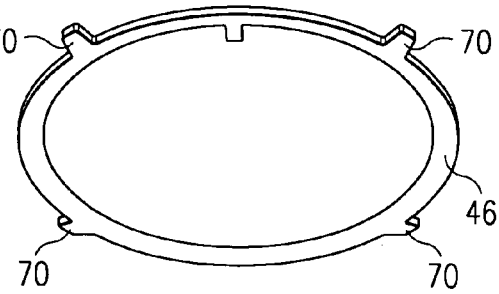
FIG. 4 is a partial perspective view, with portions broken away, of an aluminum backing ring.

In order to enhance the strength of the connection between flange assembly 38 and removable end cap 36, an aluminum backing ring 46, as shown in FIG. 4, is provided on the exterior face 48 of circular flange 44. Aluminum backing ring 46 reinforces the strength of flange 44. Another aluminum backing ring 54 is provided on the exterior face 56 of circular flange 52. Aluminum backing ring 54 provides reinforcing strength to circular flange 52. A plurality of notched protrusions 58 are provided upon end cap 36 which allow aluminum backing ring 54 to be "snapped" on, and held in place during assembly. Many other materials, including but not limited to metals and composites are suitable for fabricating reinforcement backing rings which may be interchanged with aluminum backing ring 46.

In order to enclose and seal container 30 during storage and/or transportation of rounds of ammunition, removable end cap 36 is placed over cylindrical neck 42 of flange assembly 38. Removable end cap 36 slides over cylindrical neck 42 until circular flange 52 of removable end cap 36 contacts circular flange 44 associated with storage vessel 31.

Four lever clamp assemblies 60 to be described in more detail later, are attached to removable end cap 36 to form a releasable, mechanical connection between flange assembly 38 and removable end cap 36. One aspect of the present invention includes the ability to protect contents of the container from ambient environmental conditions. This is beneficial due to technological advances and the increased sensitivity of ammunition rounds. Once container 30 is closed and sealed, potential leak paths are minimized. Therefore, the probability of the round inside remaining dry is high, regardless of ambient environmental conditions. This is particularly beneficial for any contents of container 30 which suffer from deterioration upon exposure to moisture.

The main seal between removable end cap 36 and flange assembly 38 is unique due to the reinforcement strength provided by aluminum backing rings 46 and 54. While most prior seals are either a pure facial or radial configuration, both of which require very precise fabrication tolerances, this concept is essentially a compromise between facial and radial designs. The seal will not be exposed to shear loads that often negatively impact a facial seal because of the unique way removable end cap 36 interfaces with flange assembly 38. In the illustrated embodiment, clamp assemblies 60 compress circular flange 44 firmly against circular flange 52, thereby distributing the clamp load evenly around the circumference of circular flanges 44 and 52, and maintaining uniform compression around the circumference of the gasket. Aluminum backing rings 46 and 54 provide reinforcement to circular flanges 44 and 52 respectively, preventing the deformation of circular flanges 44 and 52 in a direction parallel to the longitudinal axis X of tube 32. Deformation of circular flanges 44 and 52 will only occur along a plane perpendicular to the longitudinal axis X of tube 32, minimizing any effect on the integrity of the air tight seal therebetween.

Figure 5A:
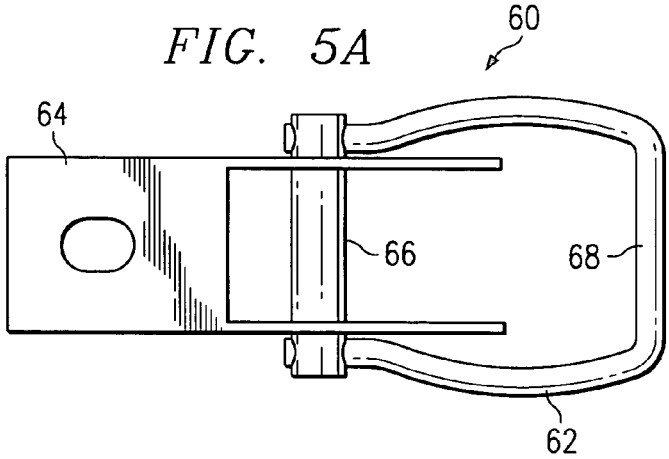
FIG. 5A is a top elevation view, with portions broken away, of a lever clamp assembly.
Figure 5:
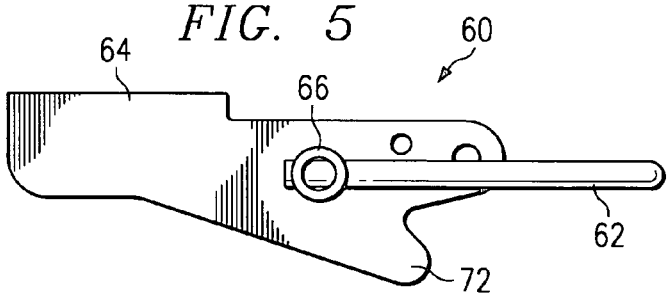
FIG. 5 is a side elevation view, with portions broken away, of a lever clamp assembly.

As illustrated in FIGS. 5A and 5, lever clamp assembly 60 includes U-bolt clamp 62, pivotally and rotationally connected to lever clamp 64, by means of a pivot clamp 66. The front bar 68 of U-bolt 62, grasps a metallic tooth 70 associated with aluminum backing ring 46 (see FIG. 4), forming a releasable connection between U-bolt 62 and aluminum backing ring 46. A hemispherical protrusion 72 incorporated into lever clamp 64, secures aluminum backing ring 54 associated with removable end cap 36, forcing compression between circular flanges 44 and 52. Other mechanical clamps and connection devices are available to accomplish this releasable connection within the teachings of the present invention.

In order to access the contents of container 30, the operator forces lever clamp 64 away from removable end cap 60 by applying pressure perpendicular to and away from longitudinal axis X of tube 32. Sufficient pressure will break the connection between hemispherical protrusion 72 and aluminum backing ring 54.

Referring now to FIGS. 1 and 3, a manual relief valve 80 is provided to allow the operator to overcome any pressure differential which may exist between the interior of container 30 and ambient atmospheric pressure, prior to removing end cap 36. By equalizing the pressure, the operator will not have to overcome the force associated with such pressure differentials.

Further, humidity indicator 82 may be provided upon removable end cap 36. This allows the operator or soldier to immediately determine whether the air tight seal of removable end cap 36 has been breached and moisture has entered container 30. Since moisture may have a detrimental effect on the contents or rounds of ammunition, the operator may want to avoid utilizing exposed munitions. In the illustrated embodiment, humidity indicator 82 is provided upon removable end cap 36. In practice, humidity indicator 82 may be placed anywhere upon container 30 provided a fluid communication path between humidity indicator 82 and the interior of container 30 is established.

In one embodiment, container 30 may constitute a pressure vessel. A pressure vessel is a chamber capable of withstanding "bursting pressures," which experience relatively little deformation under pressure. However, it is not necessary, in all cases, that vessel 31 constitutes a pressure vessel.

Figure 6:
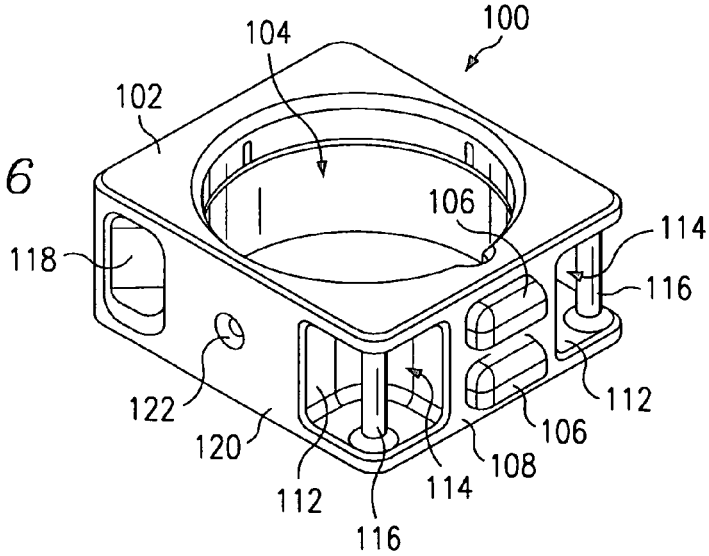
FIG. 6 is a partial elevation, with portions broken away, illustrating a stacking lug.
Figure 7:
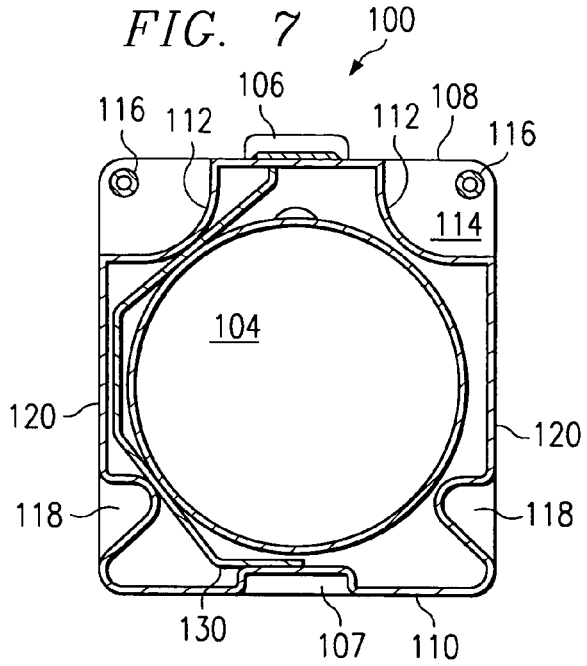
FIG. 7 is a side elevation view, with portions broken away, illustrating a stacking lug.
Figure 8:
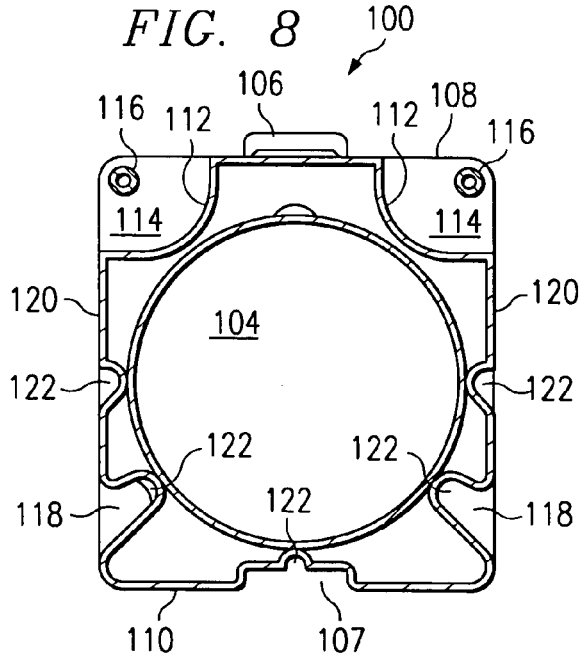
FIG. 8 is a side elevation view, with portions broken away, illustrating a stacking lug.

Many of the ergonomic features, including stackability, are accomplished by employing one or more stacking lugs 100 as illustrated in FIGS. 6–8. Stacking lugs 100 are comprised primarily of rotationally-molded, cross-linked, high density polyethylene. Other high strength material alternatives may be utilized within the teachings of the present inventions. This material is designed to handle transportation and storage loads independent of storage vessel 31 and to distribute the loads around and away from storage vessel 31. UV stabilized, cross-linked high density polyethylene exhibits high resistant to "creep" under heavy loading. This allows the user to stack multiple loaded containers without significant deformation over time.

Stacking lugs 100 include a rectangular housing 102 with a cylindrical opening 104 therethrough. Stacking lugs 100 are "press-fit" onto storage vessel 31 during fabrication of container 30. The "press-fit" connection is facilitated by providing cylindrical openings 104 of slightly smaller diameter than the diameter of tube 32. This type of connection is commonly known in the art as "press-fit" or friction fit. Although the illustrated embodiment encompasses the use of two stacking lugs disposed upon storage vessel 31 near the outermost ends, it will be recognized by those skilled in the art that the number and configuration of stacking lugs may be significantly modified within the teachings of the present inventions.

Figure 10:
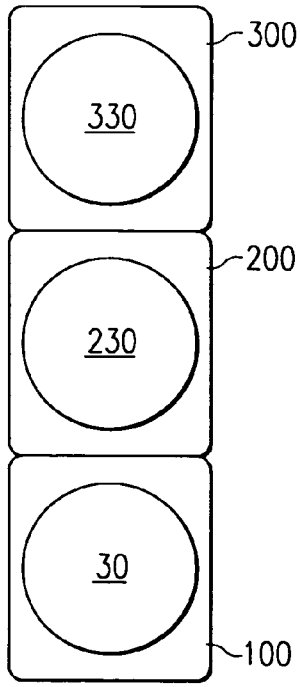
FIG. 10 is an end elevation view of three containers stacked upon one another, within the teachings of the present invention.

Stacking lugs 100 include rectangular protrusions 106 at the top face 108 of mounting lug 100 which conform to rectangular cavities 107 located at the bottom face 110 of mounting lug 100. Additional containers 230, 330 (see FIG. 10) may then be stacked upon container 30 and held in place by the friction fit of rectangular protrusion 106 and the rectangular cavity associated with the other container. When additional containers 230, 330 are placed on top of container 30, top face 108 is in contact with the bottom face of the container above. This allows most of the force from the weight of the containers above to be transferred through stacking lugs 300, 200 to top face 108 of stacking lugs 100 and very little force is transferred to storage vessel 31. This prevents deformation of storage vessel 31 under the weight of the containers above. During shipment and storage, containers will be securely held in place, yet containers may be separated quickly and efficiently during mobilization.

Quarter cylindrical cut-outs 112 occur at each corner of top face 108 of stacking lug 100, with hand-holes 114 formed therein. Handles 116, installed across the central axis of cut-outs 112, provide a lifting mechanism suitable to lift and carry container 30. A second pair of hand-holes 118 are provided within the side faces 120 of stacking lug 100, nearest the bottom face 110. Hand-holes 118 provide a convenient mechanism to lift and stack containers 30 high above ground level (e.g., loading onto a flat bed truck). Shipping and storage vehicles and structures, including additional containers, may also be adapted to accommodate rectangular protrusion 106 and rectangular cavity 107 to firmly secure container 30 in place during storage and transportation. The number, shape, size and configuration of protrusions and cavities can be significantly modified within the teachings of the present invention. The dual, parallel configuration of rectangular protrusions 106 form a convenient groove 109 which accommodates shipping straps (not expressly shown). Shipping straps may be installed over container 30, through groove 109, and secured to standard shipping pallets for secure packaging and shipment of multiple containers.

In order to reinforce the strength of stacking lug 100 a plurality of ties 122 are punched into the outer surfaces of stacking lug 100. This provides a strengthening feature by bringing the interior surface of stacking lug 100 together with the exterior surface. When the plastic material on the outside face of stacking lug 100 attaches itself to the plastic material on the inside face of stacking lug 100 a honeycomb type effect reinforces the tensile and compressive strength of stacking lug 100. This prevents stacking lug 100 from deforming under load or pressure. Ties 100 may be unnecessary for certain applications and their number and location can be varied within the teachings of present invention.

A lightning rod 130 may be encapsulated within stacking lug 100 during the fabrication process. Lighting protection is accomplished by providing a conductive path through stacking lugs 100 and around the contents of container 30. When multiple containers are stacked upon each other a continuous conducting path is formed, beginning at the top face 108 of stacking lug 100, through the interior of stacking lug 100, and around cylindrical opening 104, terminating at the bottom face 110 near rectangular cavity 107. Regardless of the number of containers 32 within a given stack, a continuous path to ground is provided by lightning rods 130.

Figure 9:
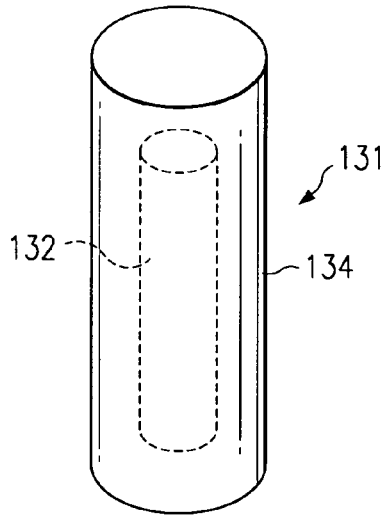
FIG. 9 is a perspective view, with portions broken away, of a weapon system incorporating aspects of the present invention.

FIG. 9 illustrates a weapon system 131. In an embodiment of the invention, a method for transporting and/or storing an item is provided. The item may include a round of ammunition 132. The method includes providing a container 134 which may be formed as previously described. The container may comprise one or more stacking lugs which may be formed as previously described. The item may be placed within container 134. The container may be sealed and the item may be maintained within the container during transportation or storage.

Although the present invention and its advantages have been described in detail, it should be understood that various changes, substitutions and alterations can be made therein without departing from the spirit and scope of the invention as defined by the appended claims.

What is claimed is:

1. A container, comprising:

a storage vessel with an interior compartment, and an access opening at one end;

a removable end cap releasably and mechanically coupled to the storage vessel and operable to close the access opening;

a first flange extending from an outer surface of the storage vessel, the first flange being sized to cooperate with a corresponding second flange extending from an exterior surface of the end cap;

a generally rectangular first stacking lug being disposed upon the outer surface and having a generally cylindrical, tubular interior diameter operable to receive the storage vessel therein; and wherein the first flange extends from the outer surface of the storage vessel at a location between the access opening and the stacking lug thereby forming a cylindrical neck between the access opening and the stacking lug.

2. The container of claim 1, further comprising a first backing ring having an opening configured to receive the storage vessel therethrough, the backing ring contacting a side of the first flange opposite the access opening and being operable to provide support to the first flange.

3. The container of claim 1, further comprising a first backing ring having an opening configured to receive the end cap therethrough, the first backing ring contacting a side of the second flange opposite the storage vessel and being operable to provide support to the first flange.

4. The container of claim 2, further comprising a second backing ring having an opening configured to receive the end cap therethrough, the second backing ring contacting a side of the second flange opposite the storage vessel and being operable to provide support to the first flange.

5. The container of claim 1, wherein the storage vessel is formed from extruded, high-density polyethylene.

6. The container of claim 1, wherein the stacking lug is formed from rotationally molded, cross-linked, high density polyethylene.

7. The container of claim 1, further comprising a manual pressure relief valve operable to create a path of fluid communication between the interior compartment and ambient environment.

8. The container of claim 1, wherein the first stacking lug comprises:

a housing with an opening disposed therethrough, the housing having a first face and a second face opposite the first face; and a first protrusion on the first face of the housing.

9. The container of claim 8, further comprising a cavity on the second face adapted to receive a second protrusion of similar size and configuration as the first protrusion, to form a releasable nested fit between the second protrusion and the cavity.

10. The container of claim 8, wherein the first face is adapted to cooperate with a third face of a separate component of similar size and configuration as the container, such that force from the weight of the separate component is transferred from the third face to the first face when the component is stacked upon the container.

11. The container of claim 1, wherein the storage vessel and removable end cap are operable to form a pressure vessel.

12. The container of claim 1, wherein the interior compartment is adapted to receive a round of ammunition therein.

13. The container of claim 1, further comprising a lever clamp assembly being operable to couple the end cap and the storage vessel.

14. The container of claim 1 wherein the stacking lug is permanently affixed to the storage vessel.

15. The container of claim 1, further comprising a lever clamp assembly coupled with the storage vessel, the level clamp assembly having a first position in which the first flange is coupled with the second flange, and a second position in which the second flange is released from the first flange.

16. The container of claim 1, further comprising a round of ammunition disposed at least partially within the storage vessel.

17. The container of claim 1, further comprising a humidity indicator in communication with the interior compartment of the storage vessel.

18. The container of claim 1, further comprising a first backing ring extending around the exterior surface of the vessel adjacent the first flange.

19. The container of claim 1, further comprising a first backing ring extending around the exterior surface of the end cap adjacent the second flange.

20. The container of claim 1, further comprising first and second backing rings extending around the exterior surface of the vessel and the exterior surface of the end cap, respectively, adjacent the first flange and the second flange, respectively.

* * * * *